US008317278B2

(12) United States Patent
Enos

(10) Patent No.: US 8,317,278 B2
(45) Date of Patent: Nov. 27, 2012

(54) RELEASABLY LOCKING SLIDE ASSEMBLIES

(75) Inventor: Kenneth E. Enos, Nunica, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 178 days.

(21) Appl. No.: 12/858,633

(22) Filed: Aug. 18, 2010

(65) Prior Publication Data

US 2012/0043872 A1 Feb. 23, 2012

(51) Int. Cl.
*A47B 88/04* (2006.01)

(52) U.S. Cl. ..... 312/333; 312/332.1; 312/334.47

(58) Field of Classification Search ..... 312/215, 312/222, 319.1, 332.1, 333, 334.8, 334.9, 312/334.7, 334.44–334.47, 348.6; 384/21; 211/26

See application file for complete search history.

(56) References Cited

U.S. PATENT DOCUMENTS

| | | | | |
|---|---|---|---|---|
| 2,655,422 | A | 10/1953 | Gussack | |
| 2,728,626 | A | 12/1955 | Gussack | |
| 3,700,301 | A | 10/1972 | Boeck | |
| 4,006,951 | A | 2/1977 | Geer et al. | |
| 4,370,007 | A * | 1/1983 | Fler | 312/334.11 |
| 4,469,384 | A | 9/1984 | Fler et al. | |
| 4,600,255 | A | 7/1986 | Dubarko | |
| 4,610,487 | A * | 9/1986 | Delmege et al. | 384/18 |
| 4,679,950 | A * | 7/1987 | Delmege et al. | 384/18 |
| 4,749,242 | A * | 6/1988 | Rechberg | 312/333 |
| 4,872,734 | A * | 10/1989 | Rechberg | 312/333 |
| 4,998,828 | A * | 3/1991 | Hobbs | 384/18 |
| 5,033,805 | A | 7/1991 | Hobbs | |
| 5,551,775 | A | 9/1996 | Parvin | |
| 5,757,109 | A | 5/1998 | Parvin | |
| 5,871,265 | A | 2/1999 | Stewart et al. | |
| 5,951,132 | A | 9/1999 | Cirocco | |
| 5,961,193 | A | 10/1999 | Hobbs | |
| 6,126,255 | A | 10/2000 | Yang | |
| 6,224,178 | B1 | 5/2001 | Cirocco | |
| 6,238,031 | B1 | 5/2001 | Weng | |
| 6,296,338 | B1 | 10/2001 | Stijns | |
| 6,412,891 | B1 | 7/2002 | Liang et al. | |
| 6,655,763 | B2 | 12/2003 | Judge et al. | |
| 6,749,276 | B2 | 6/2004 | Judge et al. | |
| 6,799,817 | B1 | 10/2004 | Chu | |
| 6,805,418 | B2 | 10/2004 | Milligan | |
| 6,817,685 | B2 | 11/2004 | Lammens et al. | |
| 6,824,233 | B2 | 11/2004 | Chen et al. | |
| 6,883,885 | B2 * | 4/2005 | Judge et al. | 312/334.46 |
| 6,926,377 | B2 | 8/2005 | Lammens et al. | |
| 6,935,710 | B2 | 8/2005 | Chen et al. | |
| 6,945,619 | B1 * | 9/2005 | Chen et al. | 312/334.47 |
| 7,029,080 | B2 | 4/2006 | Barry, Jr. et al. | |
| D535,551 | S | 1/2007 | Milligan | |
| 7,364,244 | B2 | 4/2008 | Sandoval | |
| 7,413,269 | B2 | 8/2008 | Chen et al. | |
| 7,452,040 | B1 * | 11/2008 | Burgess, III | 312/333 |
| 7,604,308 | B2 | 10/2009 | Tseng et al. | |
| 7,611,213 | B2 | 11/2009 | Wu et al. | |
| 7,648,214 | B2 | 1/2010 | Chen et al. | |

(Continued)

*Primary Examiner* — James O Hansen
*Assistant Examiner* — Daniel Rohrhoff
(74) *Attorney, Agent, or Firm* — Cook Alex Ltd.

(57) ABSTRACT

Slide assemblies having telescopic slide members, a handle assembly and open and closed positions, with either or both of the open and closed positions being a releasable locking position, while merely requiring an intuitive pushing or pulling on a handle in the direction of intended movement to both unlock and move the slide assembly from the respective optional locking position.

20 Claims, 7 Drawing Sheets

U.S. PATENT DOCUMENTS

| | | | | |
|---|---|---|---|---|
| 7,658,457 | B2 * | 2/2010 | Lu | 312/334.47 |
| 7,708,359 | B2 | 5/2010 | Peng et al. | |
| 7,712,851 | B2 | 5/2010 | Huang et al. | |
| 7,726,755 | B2 | 6/2010 | Peng et al. | |
| 7,740,328 | B2 | 6/2010 | Huang et al. | |
| 7,744,174 | B2 | 6/2010 | Peng et al. | |
| 7,744,175 | B2 * | 6/2010 | Peng et al. | 312/333 |
| 7,744,176 | B2 | 6/2010 | Milligan | |
| 7,758,134 | B2 | 7/2010 | Huang | |
| 2002/0021061 | A1 * | 2/2002 | Lammens | 312/334.44 |
| 2003/0178922 | A1 * | 9/2003 | Chen et al. | 312/334.44 |
| 2004/0056572 | A1 * | 3/2004 | Chen et al. | 312/333 |
| 2005/0017613 | A1 * | 1/2005 | Cirocco et al. | 312/333 |
| 2005/0062379 | A1 * | 3/2005 | Judge et al. | 312/334.46 |
| 2007/0241651 | A1 * | 10/2007 | Burgess et al. | 312/333 |
| 2009/0195133 | A1 * | 8/2009 | Chang | 312/334.46 |
| 2010/0019638 | A1 * | 1/2010 | Duan et al. | 312/334.44 |
| 2012/0043872 | A1 * | 2/2012 | Enos | 312/332.1 |

* cited by examiner 1
30
32
33'
36
38
37
31
35
36
31
31'
34
33
35
94
95"
95'
95
21'''
23'
28'
28
21'''
20
29
26
27
81
80
83
82
22
21''
21'
25
24'
24
25
21'
23
50
74
73'
70
73
72
71
73''
49
19
13'
16
10
18
17
16
47
42
63''
62
63'
46
45
63
61
60
44
43
48
41'
40
41
11'
13
11''
14
15
11''
16
16

RELEASABLY LOCKING SLIDE ASSEMBLIES

BACKGROUND

The present disclosure relates generally to slide assemblies having at least one releasable locking position. More specifically, the present disclosure relates to slide assemblies having telescopic slide members and a releasable latch system that provides for locking in an open position, a closed position or both of the opposed open and closed positions. In some instances, such slide assemblies are used in cabinet or desk structures to support and permit opening and closing movements of a drawer, in which case they are commonly referred to as drawer slides. However, such slide assemblies can be used in alternative environments, as desired.

It is common for slide assemblies to be configured for relatively free movement between opposed open and closed positions, although some include apparatus to assist in achieving an open or a closed position. Nevertheless, it has been recognized as advantageous for some applications to have the slide assemblies be releasably lockable exclusively when in an open, fully extended position, or exclusively when in a closed, fully retracted position, or when in either an open, fully extended position or when in a closed, fully retracted position. Indeed, there are slide assemblies with such locking open and closed positions, which may otherwise be known as having a lock-out position, a lock-in position, or both lock-out and lock-in positions. However, such known slide assemblies tend to be complex and/or have release mechanisms that permit or require operator inputs in directions that are not intuitive and convenient with respect to the intended direction of movement of the slide assembly.

SUMMARY

In a first aspect, the present disclosure includes a slide assembly having an open locking position, a closed locking position, or both open and closed locking positions, while merely requiring an actuation force of intuitive pulling on a handle toward an open position to both unlock and move the slide assembly from a closed position to a locked open position, and/or an actuation force of intuitive pushing on the handle toward a closed position to both unlock and move the slide assembly from an open position to a closed position. The slide assembly further employs a releasable latch system having a compact and efficient design with the components mounted between the slide members, so as to achieve these advantageous features within a configuration that is seen as a normal slide assembly.

In a second aspect, the disclosure includes a slide assembly that includes a plurality of slide members connected in a linear telescoping configuration, a handle assembly connected to one of the slide members and a latch system configured to releasably lock the slide members with respect to each other. The latch system is configured to be unlocked and to allow movement of the slide members when an actuation force is applied to the handle assembly in the direction of the intended linear movement of the slide members.

In a further aspect, the disclosure provides a slide assembly having a first slide member, a second slide member and a third slide member, the slide members being slidably connected in a telescoping configuration, and further including a handle assembly connected to the first slide member, and having a latch system configured to releasably lock the slide members with respect to each other. The latch system is configured to be unlocked and to allow movement of the slide members when an actuation force is applied to the handle assembly in the direction of the intended movement of the slide members.

These and other aspects of the present slide assemblies will become apparent from the following detailed description of the structure of the slide assemblies and the method of using them, when considered in conjunction with the accompanying drawings.

BRIEF DESCRIPTION OF THE DRAWINGS

While the drawings depict a slide assembly having both open and closed locking positions, it will be appreciated by one of skill in the art that consistent with this disclosure, a slide assembly may include only an open locking position, only a closed locking position, or both open and closed locking positions, but virtue of which components are included in the latching system and slide members.

DETAILED DESCRIPTION OF THE DRAWINGS

Figure 1:
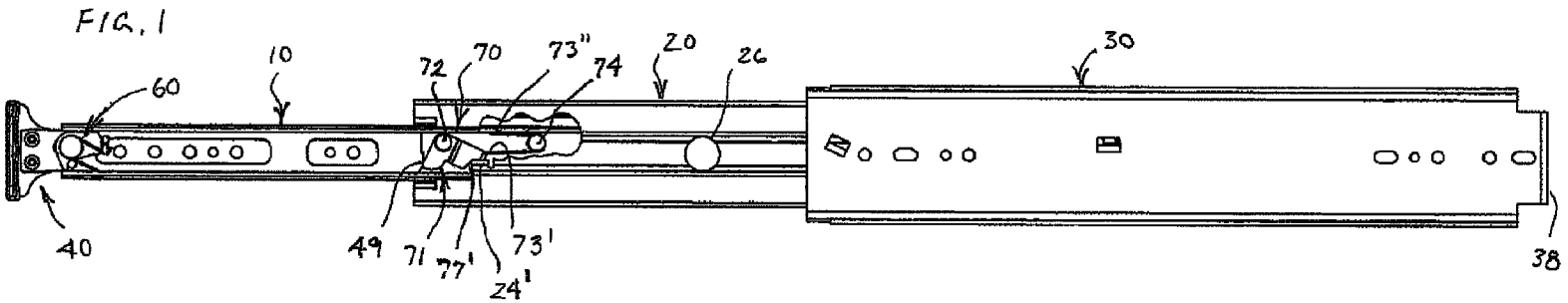
FIG. 1 is an outer side plan view of an example slide assembly that is in an open, fully extended and locked position, with a cut-away view with respect to a portion of a second slide member, showing first, second and third slide members and first and second latch assemblies.
Figure 2:
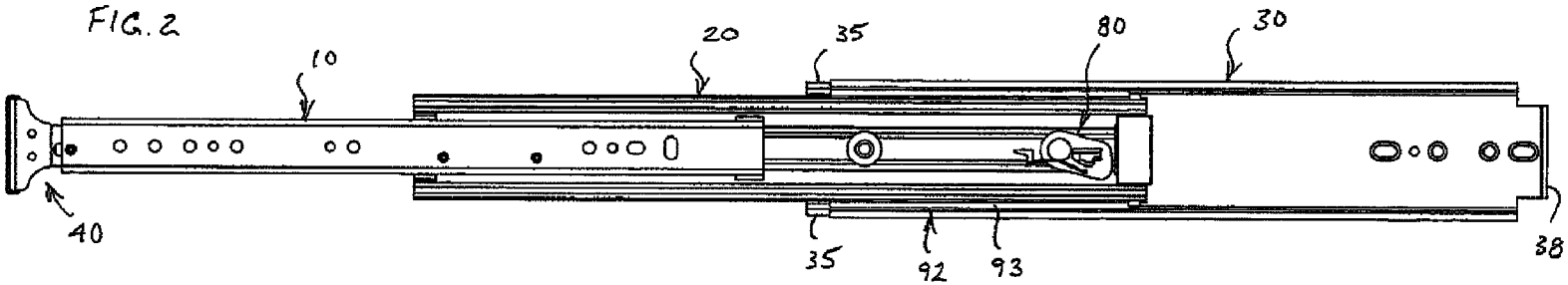
FIG. 2 is an inner side plan view of the example slide assembly of FIG. 1 in the open and locked position, and showing a third latch assembly.
Figure 3:
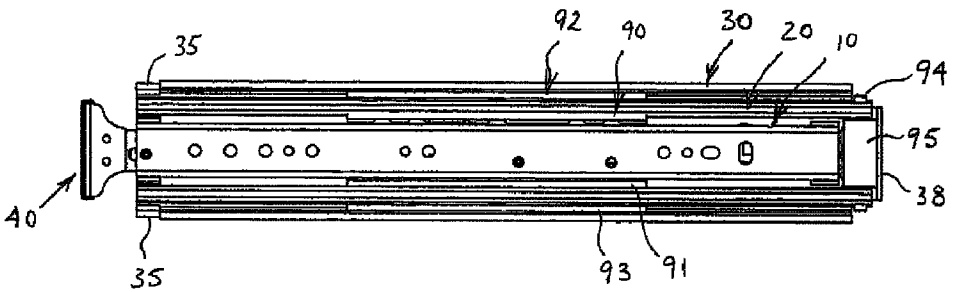
FIG. 3 is an inner side plan view of the example slide assembly of FIG. 1 in a closed, fully retracted and locked position.
Figure 4:
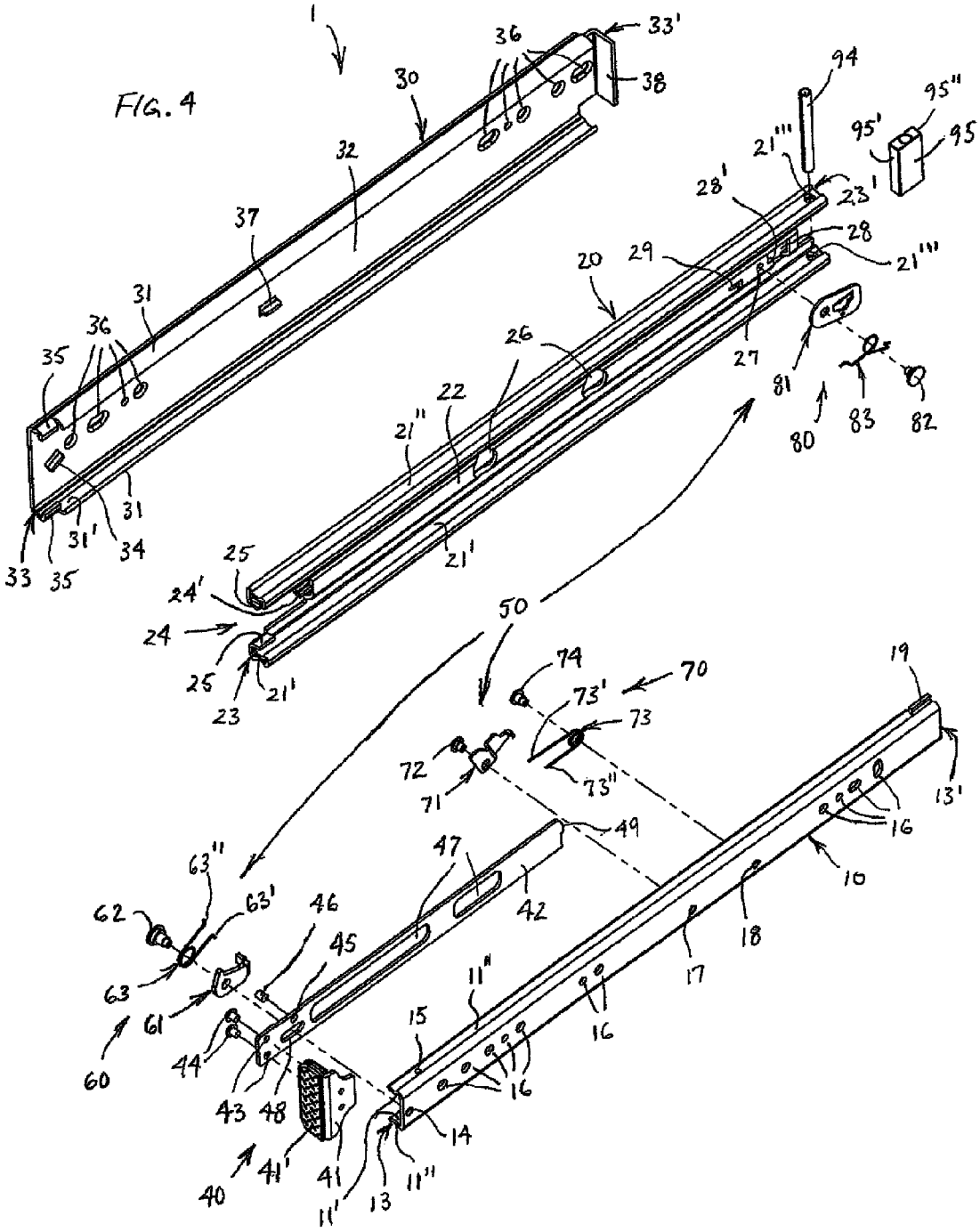
FIG. 4 is an inner side perspective exploded view of the example slide assembly of FIG. 1, with bearing related components removed for ease of viewing.

Although the following discloses an example slide assembly having releasable lock-in and lock-out positions, such as for use in supporting a drawer from a cabinet or other structure, persons of ordinary skill in the art will appreciate that the teachings of this disclosure are in no way limited to the specific structure of the example. On the contrary, it is contemplated that the teachings of this disclosure may be implemented in alternative configurations and environments. Indeed, it will be appreciated that a slide assembly may be constructed to have only a lock-in position when closed, without locking in the fully extended, open position, or to have only a lock-out position when open, without locking in the fully retracted, closed position. Also those having ordinary skill in the art will readily recognize that the example slide assembly may be used for supporting and translating other structures relative to each other, and other configurations and constructions could be employed to accommodate the specific needs of a user. Accordingly, while the following describes an example slide assembly and methods of operating such a slide assembly, persons of ordinary skill in the art will readily appreciate that the disclosed example is not the only way to implement such a slide assembly within the scope and spirit of the appended claims.

As illustrated in FIGS. 1-18, example slide assembly 1 includes a first slide member 10, a second slide member 20, and an third slide member 30. A handle assembly 40 is slidably connected to the first slide member 10, and the slide assembly includes a releasable latch system 50, having a first latch assembly 60, a second latch assembly 70 and a third latch assembly 80.

The slide members 10, 20 and 30 are configured for telescopic sliding motion and are preferably of metal construction, such as steel or other suitable materials. Thus, the first slide member 10 telescopically slides relative to the second slide member 20, such as by use of first bearing assemblies 90 having first bearing retainers 91 and associated bearings, such as ball bearings (not shown), while the second slide member 20 further telescopically slides relative to the third slide member 30, such as by use of second bearing assemblies 92 having second bearing retainers 93 and associated bearings, such as ball bearings (not shown). The bearing retainers are preferably constructed of molded plastic but may be of plastic or metal construction. It will be appreciated that the sliding engagement between the respective slide members could be achieved with suitable structures other than ball bearings, which typically would be constructed of hardened steel or other suitable materials. Also, the reference to telescoping is not intended to mean that the slide members must be configured to have each successive slide member be located within the next slide member. Rather, telescoping is intended to be used to mean any configuration in which each successive slide member extends some distance further than an adjacent slide member when in an open position.

In the illustrated example, the first slide member 10 includes opposed flanges 11 and a web 12 therebetween. The front end 13 of the first slide member 10 includes an aperture 14 in the web 12 that receives a pivot of the first latch assembly 60, and an aperture 15 in a flange 11 that receives an end of a spring of the first latch assembly 60. The web 12 further includes apertures 16 for mounting the first slide member 10 to another structure, such as a drawer (not shown). Proximate a central region of the first slide member 10 are apertures 17 and 18 that receive respective pivots for the second latch assembly 70. The flanges 11 slidably receive a portion of the handle assembly 40 on a portion of their inner surface 11' while engaging the first bearing assemblies 90 on their outer surfaces 11". The flanges 11 also include bearing retainer stops 19 that are formed in this example as projections at the rear end 13' of the first slide member 10 and that act as stops for the first bearing retainers 91.

The second slide member 20 includes opposed flanges 21 and a web 22 therebetween. The front end 23 of the second slide member 20 includes an opening 24 in the web 12, with a stop 24' that is formed in this example as a tab extending from the web 12 for engagement with the second latch assembly 70 and bearing retainer stops 25 that are formed in this example as projections at the front end 23, and that act as stops for the first bearing retainers 91. The web 22 further includes apertures 26 proximate a central region for access to other fasteners. Proximate the rear end 23' of the second slide member 20, the web 22 has an aperture 27 for a pivot of the third latch assembly 80, an opening 28 which permits access by the third latch assembly 80 to the third slide member 30, and an aperture 29 that receives an end of a spring of the third latch assembly 80. The flanges 21 engage the first bearing assemblies 90 on their inner surfaces 21' and engage the second bearing assemblies 92 on their outer surfaces 21".

The third slide member 30 includes opposed flanges 31 and a web 32 therebetween. Proximate the front end 33 of the third slide member 30, the web 32 includes a front stop 34 that is formed in this example as a tab, for engagement with the first latch assembly 60. The flanges 31 include bearing retainer stops 35 that are formed in this example as projections at the front end 33, and that act as stops for the second bearing retainers 93. The flanges 31 engage the second bearing assemblies 92 on their inner surfaces 31'. The web 32 includes apertures 36 for mounting the third slide member 30 to another structure, such as a cabinet (not shown). The web 32 further includes a rear stop 37 that is formed in this example as a tab and that is located in a central region of third slide member 30 for engagement with the third latch assembly 80. At the rear end 33' of third slide member 30, the web 32 has a central stop 38 that is formed in this example as a large tab and that acts as a rear stop for the second slide member 20.

The flanges 21 of the second slide member 20 also include apertures 21'" to receive a fastener 94, such as a press fit steel roll pin, or other suitable fastener, and the outer ends of the fastener 94 act as bearing retainer stops for the second bearing retainers 91. The fastener 94 also is used to connect a resilient block 95 to the second slide member 20. The resilient block 95 preferably is made of a foam rubber or other suitable material and acts as a bumper by providing a cushioned stop for the first slide member 10 against the front side 95', as well as a cushioned stop of the second slide member 20 as the rear side 95" stops against the central tab 38 of the third slide member 30. It will be appreciated that the resilient block 95 could be connected to the second slide member 20 separately or in other ways if such integrated cushioned stopping is desired, or cushioned stopping could be provided by other suitable structures.

The handle assembly 40 of the slide assembly 1 of the illustrated example includes a handle 41, which is connected to a slider 42, both of which preferably are of metal construction, such as steel, although other suitable materials could be used. In this example, the handle 41 has a right-angled bend to permit easy grasping by a user at its front end while permitting easy connection to the flat slider 42 at its rear end. The handle 41 includes a partial cover 41' that is constructed of plastic, rubber or other suitable materials for more comfortable gripping. The slider 42 has apertures 43 at its front end to receive fasteners 44 used to connect the handle 41 to the slider 42. The slider 42 also includes an aperture 45 that receives a pin 46, preferably constructed of steel or other suitable material, and that is connected to the slider 42, such as by press fit, welding or by other suitable methods of connection. The slider 42 has elongated openings 47 along its length to permit access to mounting fasteners that are installed through the apertures 16 in the first slide member 10. A further elongated aperture 48 is located proximate the front end of the slider 42. A post that serves as a pivot for the first latch assembly 60 passes through the elongated aperture 48 in a manner that holds the slider 42 to the web 12 of the first slide member 10, while permitting the slider 42 to slide relative to the first slide member 10, as will be discussed herein in more detail. The rear end of the slider 42 has a stepped surface 49 that selectively engages a latch body of the second latch assembly 70.

Turning to the structures of the releasable latch system, the slide assembly 1 includes a releasable latch system 50 having a compact and efficient design with the components mounted between the slide members. In this particular example, the releasable latch system 50 allows the slide assembly 1 to achieve releasable lock-in and lock-out positions within a configuration that is otherwise seen as a normal slide assembly. The releasable latch system 50 is configured to be unlocked and to allow linear movement of the slide members 10, 20, 30 when the handle assembly 40 is subjected to an actuation force in the direction of the intended linear movement of the slide members. The slide assembly 1 includes a releasable lock-in position when the slide members are in a closed, fully retracted position and a releasable lock-out position when the slide members are in an open, fully extended position. The releasable latch system includes latches that are configured so that they will automatically lock the slide assembly 1 in the lock-out position when the handle assembly 41 receives a linear actuation force in the direction of extending the slide assembly to an open, fully extended position, and will automatically lock the slide assembly 1 in the lock-in position when the handle assembly 41 receives a linear actuation force in the direction of retracting the slide assembly to a closed, fully retracted position. It will be appreciated that the slide assembly could be constructed with a latch system having fewer components and which provides only a lock-out position or only a lock-in position, as discussed further herein.

Within the releasable latch system 50 of the example slide assembly 1 having both lock-out and lock-in positions, the first latch assembly 60 includes a first latch 61, a post 62 and a resilient element 63. In this example, the first latch 61 preferably is constructed of metal, such as steel or other suitable materials, and the resilient element 63, in this example, is preferably constructed as a coiled torsion spring made of spring steel, however, other configurations and/or suitable materials could be used. The first latch 61 and resilient element 63 are pivotally movable about the post 62 which is preferably constructed of metal, such as steel or other suitable materials, and the post 62 is connected to the first slide member 10 at the aperture 14 therein, such as by press fit, welding or other suitable methods.

The first latch 61 has a main planar portion 64 that lies adjacent the slider 42 and includes a locking member 65 formed as a tab at its rear and that extends generally perpendicular to the main planar portion 64. The first latch 61 also includes an upstanding lever 66. The locking member 65 includes a small groove 67 that receives a first end 63' of the resilient element 63 with a second end 63" of the resilient element 63 being received in the aperture 15 in the flange 11 of the first slide member 10. The resilient element 63 in the illustrated example biases the first latch 61 to rotate to a neutral position where an edge of the main planar portion 64 engages the inner surface 11' of a flange 11 on the first slide member 10. This position permits locking in the closed position of the slide assembly 1 when the locking member 65 comes to rest behind the front stop 34 on the third slide member 30, as will be described further herein. Thus, a slide assembly could be made to have only a lock-in position if it includes just a latch assembly such as the first latch assembly 60.

Figure 9:
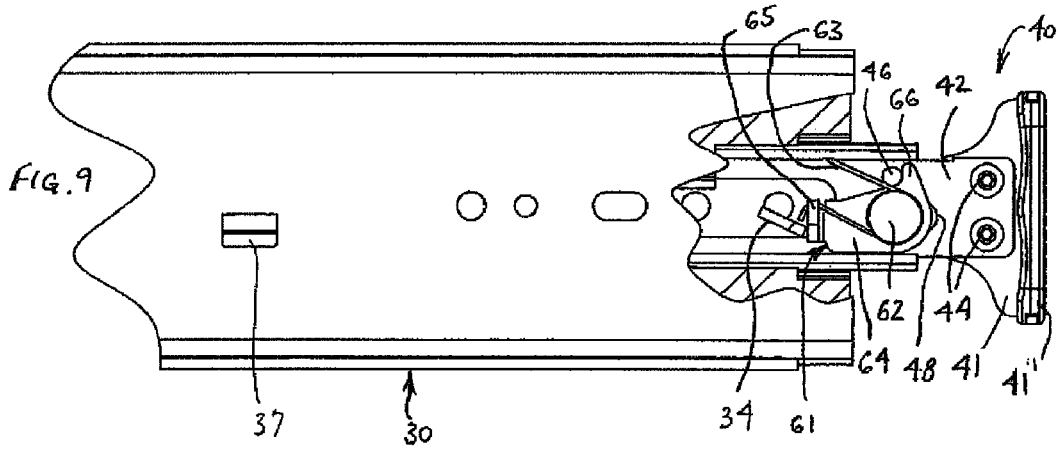
FIG. 9 is an outer side plan view of a front portion of the example slide assembly of FIG. 1 in a nearly closed position showing initial engagement of the first latch assembly with a front stop on the third slide member, with a portion of the front of the third slide member and a portion of the rear of the slide assembly removed.
Figure 10:
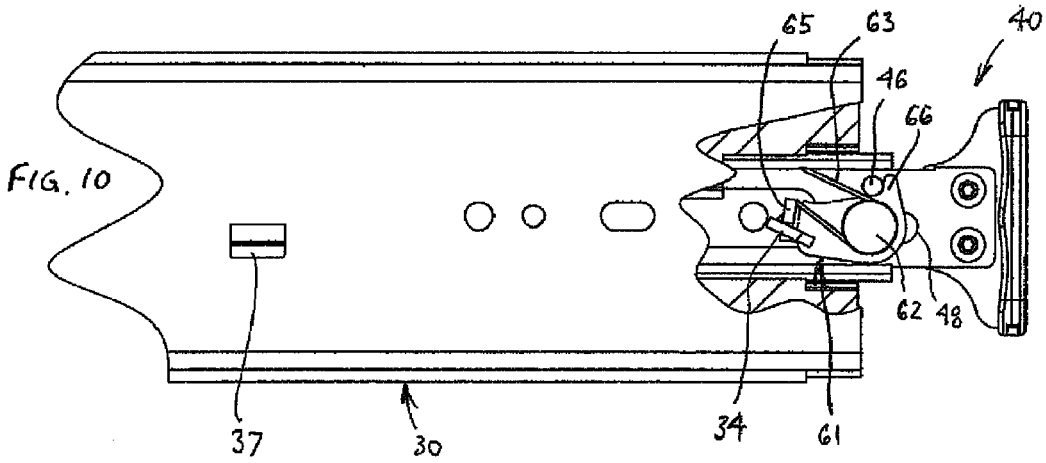
FIG. 10 is an outer side plan view of the front portion of the example slide assembly of FIG. 1 with the slide assembly moved slightly closer to a fully closed position than in FIG. 9, showing movement of the first latch along the front stop on the third slide member.
Figure 11:
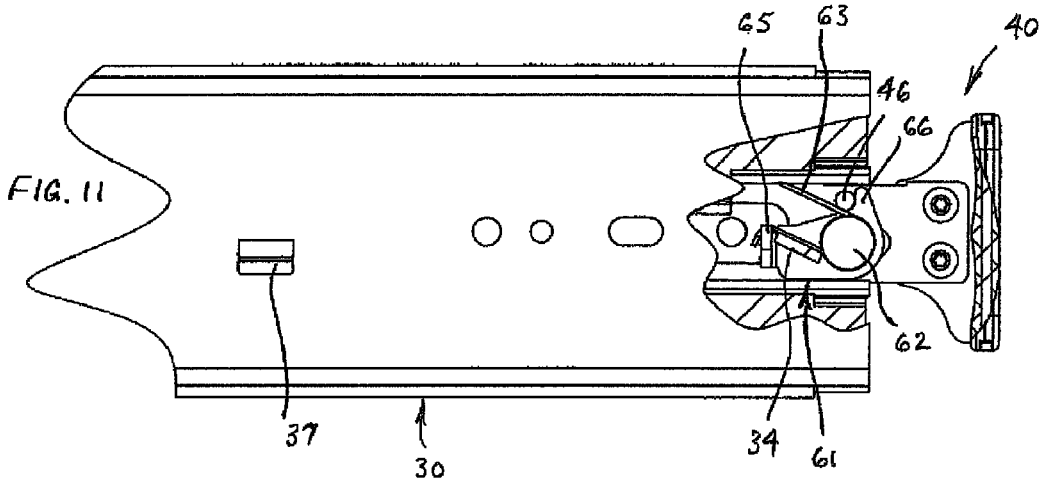
FIG. 11 is an outer side plan view of the front portion of the example slide assembly of FIG. 1 with the slide assembly moved to the fully closed position, showing the first latch having reached a locked position behind the front stop on the third slide member.

It will be appreciated that the first latch 61 may be automatically rotated against the biasing force of the resilient element 63 when the locking member 65 contacts the front stop 34 and rides up and over the stop 64 as the slide assembly 1 nears the fully closed position and regardless of whether or not the handle assembly 40 is being pushed in route to the closed position, as best seen in the sequence of FIGS. 9-11. Thus, once the slide assembly 1 is moving in a closing direction, momentum or pushing on anything including or to which the first slide member 10 is connected will cause the slide assembly 1 to eventually achieve a fully retracted, closed position.

Figure 12:
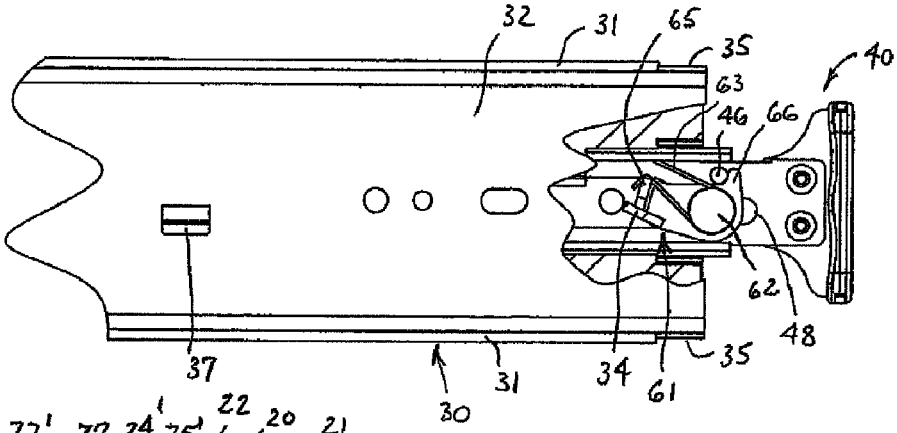
FIG. 12 is an outer side plan view of a front portion of the example slide assembly of FIG. 1 where the slide assembly was in the closed and locked position shown in FIG. 11 but the handle assembly now has been pulled, unlocking the first latch, and the first slide member is moved slightly toward an open position.

Further, when opening the slide assembly 1 from a fully closed position, it will be understood that the first latch 61 may be rotated against the biasing force of the resilient element 63 when the handle assembly 40 is pulled, causing the slider 42 and its pin 46 to drive forward the lever 66 of the first latch 61 relative to the post 62, as the slider 42 slides relative to the first slide member 10 until the end of the elongated slot 48 engages the post 62. This causes the locking member 65 to be lifted over the front stop 34 on the third slide member 30 to unlock the first slide member 10 from the third slide member 30 when pulling on the handle assembly 40 to extend the slide assembly 1 from its fully closed position toward an open, extended position, as best seen in the sequence of FIGS. 11-12. In turn, once the first latch assembly 60 is unlocked, the momentum or further pulling on anything including or to which the first slide member 10 is connected will cause the slide assembly 1 to eventually achieve a fully extended, open position.

Turning to the second latch assembly 70, there is a second latch 71, a first post 72, a resilient element 73 and a second post 74. The first post 72 is connected to the second slide member 20 at aperture 17 for pivotal connection of the second latch 71 to the second slide member 20. The second post 74 is connected to the second slide member 20 at aperture 18 for pivotal connection of the resilient element 73 to the center slide member 20. The construction materials and basic connection of the second latch 71, the first post 72, the resilient element 73, and the second post 74 to the second slide member 20 are similar to that which was described above for the components of the first latch assembly 60, but need not necessarily be similar.

The second latch 71 has a main planar portion 75 that lies adjacent the second slide member 20 and further includes an offset portion 76, a locking member 77 in the form of a secondary planar portion that is substantially parallel to the main planar portion 75, and a tab 78 at its rear that extends generally perpendicular to the secondary planar portion 77. The locking member 77 includes a locking surface 77' that selectively engages the respective stop 24' on the front end 23 of the second slide member 20. The second latch 71 also includes an upstanding lever 75' that is an upward extension of the main planar portion 75. The tab 78 includes a small groove 79 that receives a first end 73' of the resilient element 73 with a second end 73" of the resilient element 73 engaging the inner surface 11' of a flange 11 on the first slide member 10.

Figure 5:
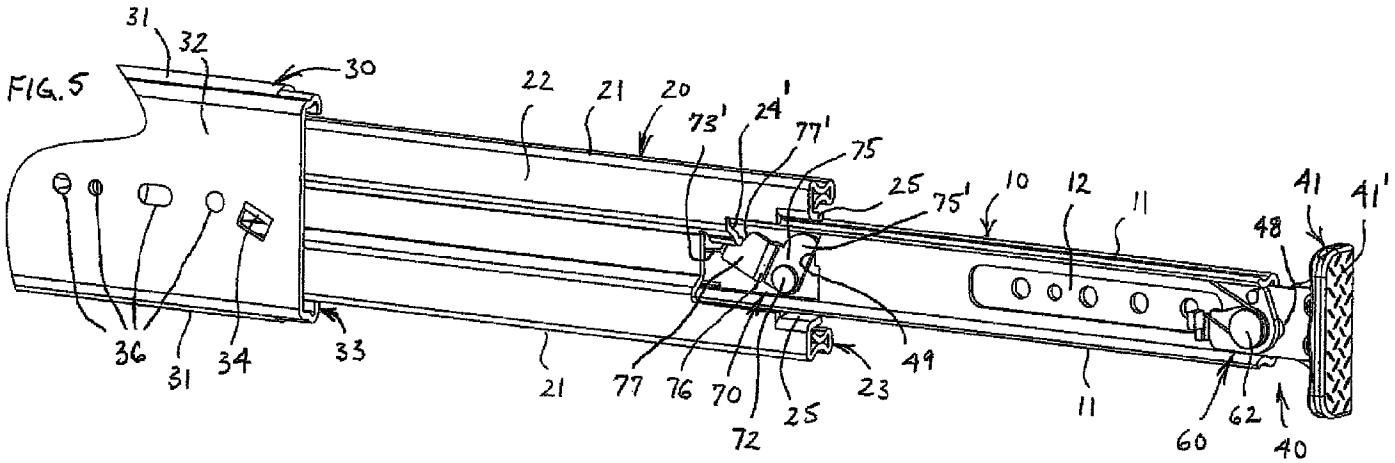
FIG. 5 is an outer side perspective view of the example slide assembly of FIG. 1 in the open, fully extended and locked position, showing the first and second latch assemblies, with a portion of the rear of the slide assembly removed.

The resilient element 73 in the illustrated example biases the second latch 71 to rotate to a neutral position where the lever 75' engages the stepped surface 49 at the rear end of the slider 42, when the first latch assembly 60 also is in its above-described neutral position, as best seen in FIG. 5. This neutral position permits locking the slide assembly 1 in the open position of the first slide member 10 in an extended position relative to the second slide member 20 when the stop 24' on the second slide member 20 comes to rest behind the locking surface 77' of the locking member 77 on the second latch 71.

When the slide assembly 1 is in the fully extended, lock-out position, it will be appreciated that the second latch 71 may be rotated against the biasing force of the resilient element 73 when the handle assembly 40 is pushed so as to move the slide assembly 1 toward a closed position, thereby causing the stepped surface 49 on the rear end of the slider 42 to push the lever 75' rearward relative to the post 72 on the second slide member 20. This causes the release of the second latch assembly 70 as the stop 24 rides up and over the locking surface 77' of the locking member 77, as best seen in stepping from FIG. 5 to FIG. 7. The stepped surface 49 on the rear end of the slider 42 permits the slider 42 to push the lever 75' of the second latch 71 beyond a position that would have the leading edge of the lever 75' simply perpendicular to the first slide member 10. The offset main planar portion 75 and locking member 77 permit the second latch 71 to then move past the stop 24' as the first slide member 10 is pushed rearward toward a closed position.

Figure 13:
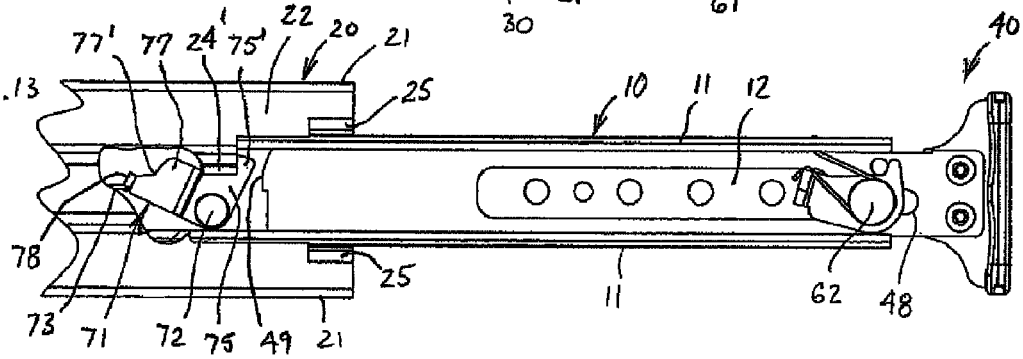
FIG. 13 is an outer side plan view of a front portion of the example slide assembly of FIG. 1 where the slide assembly has continued to be moved toward an open position from the position shown in FIG. 12 and the first slide member has nearly completely extended relative to the second slide member, and the second latch assembly has reached initial engagement with a front stop on the second slide member, with a portion of the front of the second slide member and a portion of the rear of the slide assembly removed.
Figure 14:
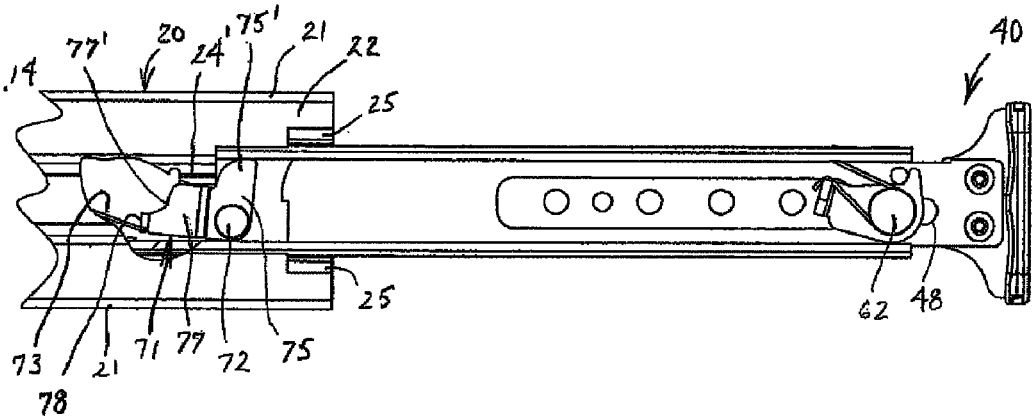
FIG. 14 is an outer side plan view of a front portion of the example slide assembly of FIG. 1 where the slide assembly has continued to be moved toward an open position from the position shown in FIG. 13 and the first slide member has extended slightly further, with the second latch moving along the front stop on the second slide member.
Figure 15:
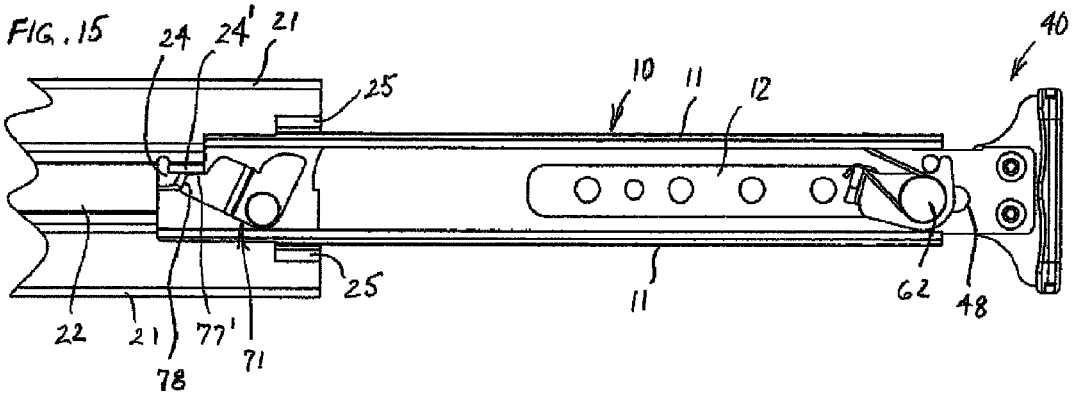
FIG. 15 is an outer side plan view of a front portion of the example slide assembly of FIG. 1 where the slide assembly has continued to be moved toward an open position from the position shown in FIG. 14 and the first slide member has been fully extended relative to the second slide member, with the second latch having reached a locked position forward of the front stop on the second slide member.

Further, when the slide assembly 1 is in the fully retracted, lock-in position, the second latch 71 may be automatically rotated against the biasing force of the resilient element 73 when the handle assembly 40 is pulled, causing the slider 42 to slide forward relative to the first slide member 10 until the elongated slot 48 engages the post 62, thereafter causing the handle assembly 40 to pull the first slide member 10 toward an extended position relative to the second slide member 20. As best seen in the sequence of FIGS. 13-15, as the second latch assembly 70 on the first slide member 10 is being pulled forward, the stop 24' engages the locking member 77 and rotates the second latch 71 so as to allow the stop 24' to ride over the locking member 77 until the stop 24' comes to rest against the locking surface 77' on the rear of the second latch 71 when the first slide member 10 is moved to a fully extended position relative to the second slide member 20.

Turning to the third latch assembly 80, there is a third latch 81, a post 82 and a resilient element 83. The post 82 is connected to the second slide member 20 at aperture 27 for pivotal connection of the third latch 81 and the resilient element 83 to the second slide member 20. The construction materials and basic connection of the third latch 81, the post 82, and the resilient element 83 to the center slide member 20 are similar to that which was described above for the components of the first and second latch assemblies 60, 70, but need not necessarily be similar.

The third latch 81 has a main planar portion 84 that lies adjacent the second slide member 20 and further includes an offset portion 85 that extends through the opening 28 in the web 22 of the second slide member 20, and a locking member 86 in the form of a secondary planar portion that is substantially parallel to the main planar portion 84. The locking member 86 includes a locking surface 86' that selectively engages the rear stop 37, which is located in the central region of the third slide member 30. The third latch 81 also includes an engagement surface 87 along an outer edge that is configured to be engageable by the inner surface 21' of a flange 21 on the second slide member 20. The main planar portion 84 includes an aperture 84' that receives a first end 83' of the resilient element 83 with a second end 83" of the resilient element 83 received by the aperture 29 in the web 22 of the second slide member 20.

Figure 6:
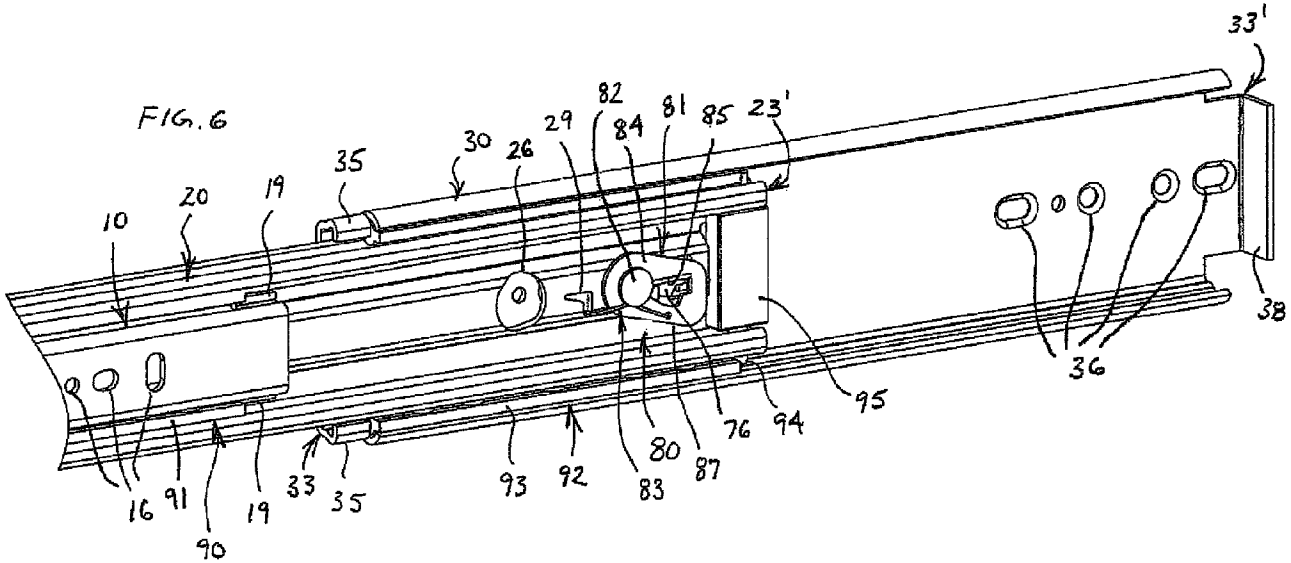
FIG. 6 is an inner side perspective view of the example slide assembly of FIG. 1 in the open, fully extended and locked position, showing the third latch assembly, with a portion of the front of the slide assembly removed.
Figure 16:
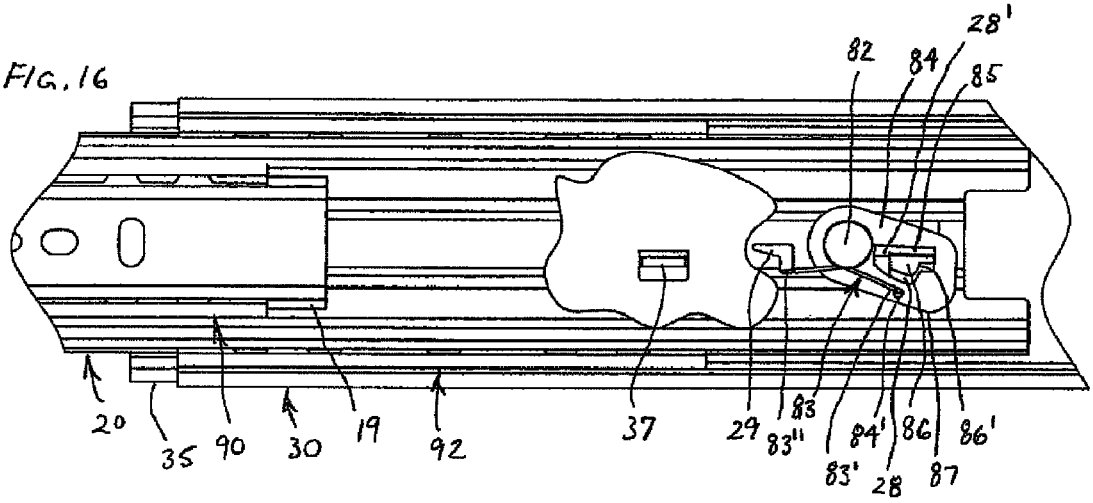
FIG. 16 is an inner side plan view of a central portion of the example slide assembly of FIG. 1 showing the rear of the second slide member with a third latch assembly approaching a rear stop on the third slide member as the slide has continued to be moved and the slide assembly has continued to be extended from the position shown in FIG. 15, with the second slide member nearly completely extended relative to the third slide member, and with a portion of the front of the third slide member and portions of the front and rear of the slide assembly removed.

The resilient element 83 in the illustrated example biases the latch body 81 to rotate to a neutral position which is shown in FIGS. 6 and 16. By virtue of the offset portion 85 extending through the opening 28, the main planar portion 84 and the locking member 86 are interleaved with a portion of the web 22, and the offset portion 85 of the biased third latch 81 rests against a stop surface 28' in the opening 28 when in the neutral position. This neutral position permits locking in the open position of the second slide member 20 in an extended position relative to the third slide member 30 when the locking member 86 rides up and over the rear stop 37 on the third slide member 30, so that the locking surface 86' on the locking member 86 comes to rest forward of the rear stop 37.

It will be appreciated that the third latch 81 may be rotated against the biasing force of the resilient element 83 when the slide assembly 1 has been unlocked and is moving toward a closed position, with the above-described release of the second latch assembly 60, thereby allowing the first and second slide members 10, 20 to be moved rearward. As the rear end 13' of the first slide member 10 engages the engagement surface 87 on the third latch 81, the engagement surface 87 rides up and into engagement with the inner surface 11' of the first slide member 10, rotating the third latch 81, as is about to occur in FIG. 8. This causes the release of the third latch assembly 80 as the locking surface 86' is disengaged from and moves over the rear stop 37. Thus, upon rotation of the third latch 81 due to the engagement with the inner surface 11' of the first slide member 10, the third latch assembly 80 releases from the locked position shown in FIG. 18 and permits the slide assembly 1 to continue to be moved toward a fully closed position.

Figure 17:
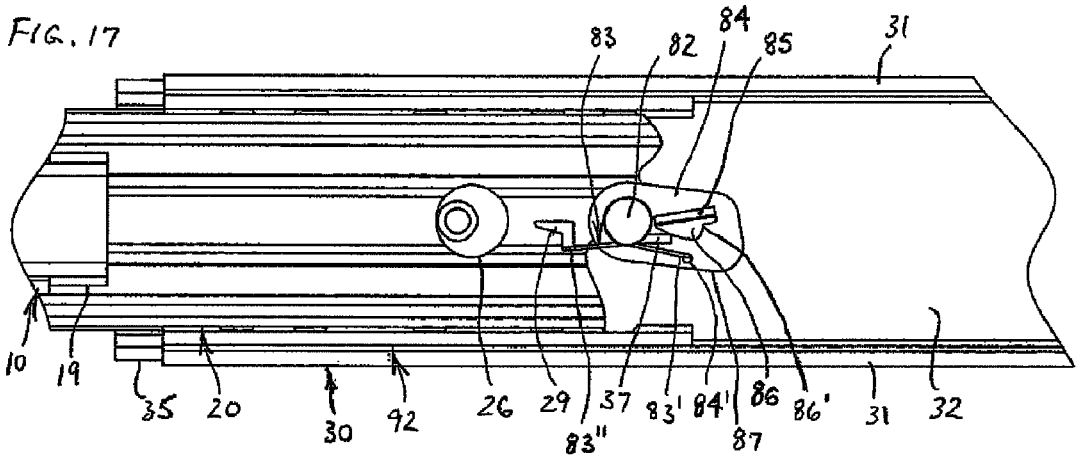
FIG. 17 is an inner side plan view of a central portion of the example slide assembly of FIG. 1 showing initial engagement between the operative portions of the third latch on the rear of the second slide member and the rear stop on the third slide member as the slide assembly has continued to be extended toward an open position from the position shown in FIG. 16.
Figure 18:
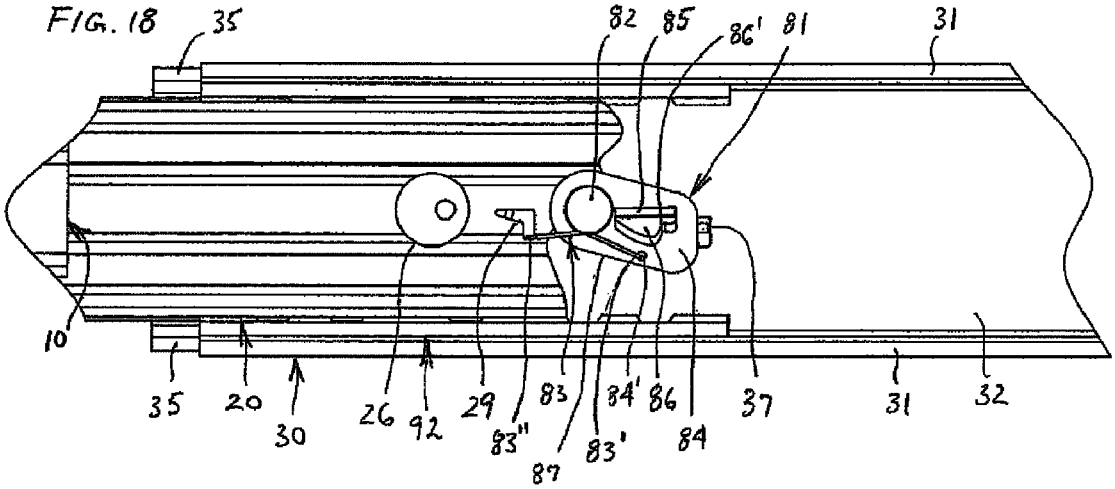
FIG. 18 is an inner side plan view of a central portion of the example slide assembly of FIG. 1 where the slide assembly has continued to be extended from the position shown in FIG. 17 and has achieved an open, fully extended position, and showing the third latch having reached a locked position forward of the rear stop on the third slide member.

Further, the third latch 81 may be automatically rotated against the biasing force of the resilient element 83 when the slide assembly 1 is moved toward an open position, such that the first slide member 10 moves toward an extended position relative to the second slide member 20, eventually reaching the locked position of the second latch assembly 70 shown in FIG. 5, and the second slide member 20 then moves toward a fully extended position, as well. As best seen in the sequence of FIGS. 16-18, as the third latch assembly 80 on the second slide member 20 is being pulled forward, the rear stop 37 on the third slide member 30 engages the locking surface 86' on the locking member 86 and rotates the third latch 81, so as to allow the locking member 86 to ride over the rear stop 37 until the locking surface 86' comes to rest against the front of the rear stop 37 on the third slide member 30 as the fully extended, open position of the slide assembly 1 is achieved.

Having set forth the structures and some of the basic movements of components within the slide assembly 1, the operation of the slide assembly 1 can be described more fluidly. For instance, the slide assembly 1 is shown in an open, fully extended and locked out position within FIGS. 5 and 6. In this position, the first, second and third latch assemblies 60, 70 and 80 are in their neutral positions, with the second and third latch assemblies 70, 80 locked out when the slide assembly 1 is in this open position.

Figure 7:
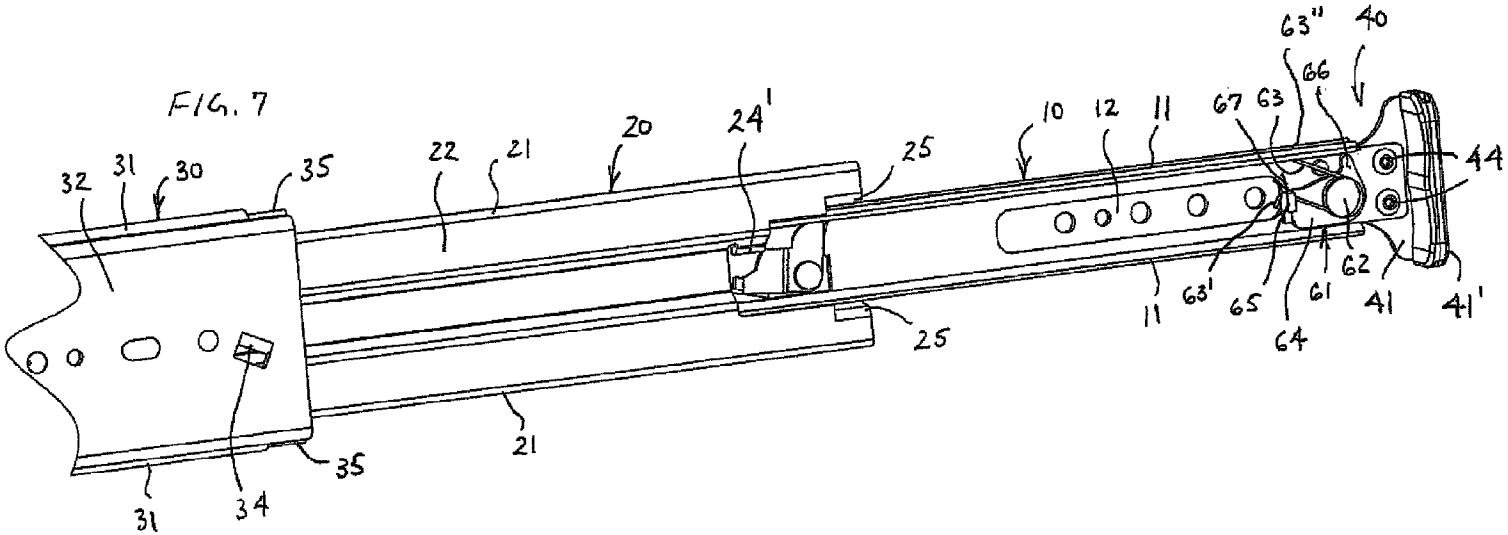
FIG. 7 is an outer side perspective view of the example slide assembly of FIG. 1 in an extended position where a handle assembly is initially pushed toward a closed position and disengaging from the first latch assembly, while engaging and unlocking the second latch assembly, with a portion of the rear of the slide assembly removed.
Figure 8:
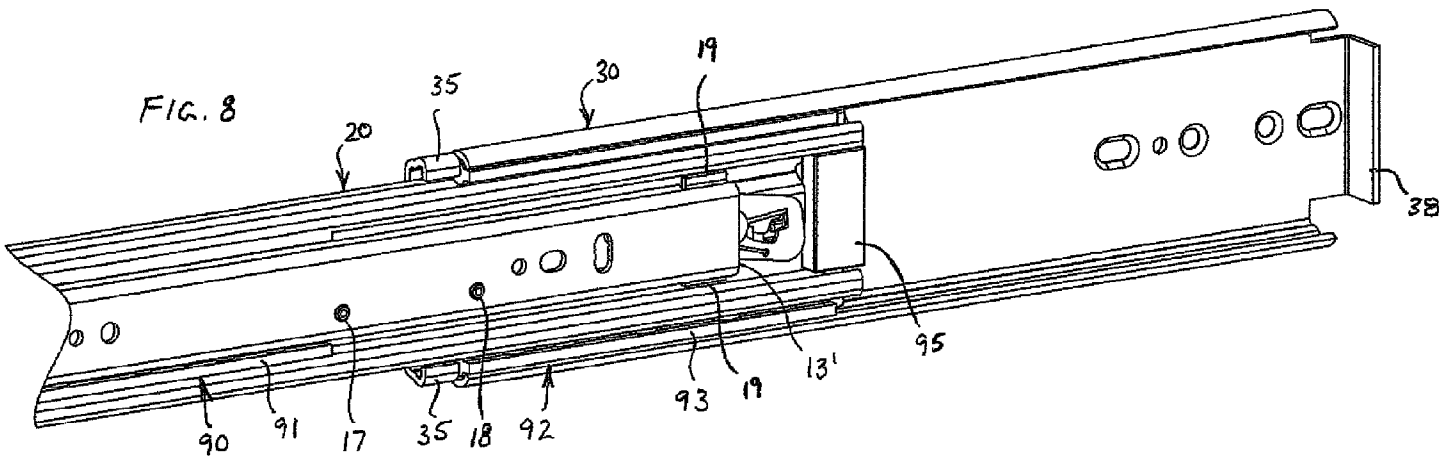
FIG. 8 is an inner side perspective view of the example slide assembly of FIG. 1 in a partially closed position where the first slide member has been moved toward the rear of the second slide member, with the first slide member nearing unlocking engagement with the third latch assembly, with a portion of the front of the slide assembly removed.

FIGS. 7 and 8 then present positions reached during the completely intuitive operation of moving the slide assembly 1 to a fully closed position. For instance, in FIG. 7, a pushing actuation force is being applied to the handle assembly 40 which is causing the stepped surface 49 of the slider 42 to engage and rotate the lever 75' on the second latch 71 of the second latch assembly 70 to a release position. This rotates the second latch 71 until the first slide member 10 is able to move freely rearward, such as shown in FIG. 8. Eventually as the first slide member 10 engages the engagement surface 87 of the third latch 81, the third latch 81 is rotated to a release position to permit the first and second slide members 10, 20 to move freely rearward toward a closed position until, as seen in FIGS. 9-11, the locking member 65 on the first latch 61 of the first latch assembly 60 engages and rides up and over the front stop 34 on the third slide member 30, and the rear end 13' engages the resilient block 95 which engages the central stop 38 on the rear end 33' of the third slide member 30. At this point, the slide assembly 1 is fully closed, as best seen in FIG. 1. Thus, the operator simply uses a completely intuitive action of initially pushing on the handle 41 of the handle assembly 40 in a closing direction and the slide assembly 1 automatically releases to allow closing and eventually then achieves a lock-in, fully closed position.

Turning to FIGS. 12-18, one will appreciate the operation of the slide assembly 1 as an operator applies a completely intuitive pulling actuation force on the handle 41 of the handle assembly 40. In FIG. 12, the handle assembly 40 is pulled and its pin 46 engages lever 66 to rotate the first latch 61 until the locking member 65 moves over the front stop 34 on the third slide member 30. This permits the first slide member 10 to move freely forward toward an open position until, as seen in FIG. 13, the second latch 71 engages the stop 24' on the second slide member 20. As seen in FIGS. 13-15, the second latch 71 then rotates to ride over and the stop 24' until the locking surface 77' on the locking member 77 of the second latch 71 engages the stop 24', thereby locking the first slide member 10 in an extended position relative to the second slide member 20 (note that the rearward end of the first slide member 10 extends beyond the stop 24', but the view of it is blocked by the second slide member 20).

Then, as the second slide member 20 extends toward an open, fully extended position, the third latch 81 of the third latch assembly 80 engages the rear stop 37, located in a central region on the third slide member 30. This sequence of movements is shown in FIGS. 16-18 where the locking member 86 engages and rides over the rear stop 37 until the rear stop 37 rests against the locking surface 86' on the rear of the locking member 86, as shown in FIG. 18. At this point, the slide assembly 1 is in an open, fully extended position. Thus, after the operator simply uses a completely intuitive action of pulling on the handle 41 of the handle assembly 40 to unlock and move the slide assembly 1 in an opening direction, upon further movement toward the open position, the second and third latch assemblies 70, 80 of the slide assembly 1 automatically engage and eventually lock the slide assembly 1 in the open or lock-out position.

One will appreciate that the releasable latching system 50 of the illustrated example results in a device which does not require one to learn how to operate the slide assembly 1, despite its capabilities to provide releasable lock-in and lock-out positions.

While the present disclosure shows and demonstrates an example of a slide assembly that may be adapted for use with releasable lock-in and lock-out positions, the example is merely illustrative and is not to be considered limiting. It will be apparent to those of ordinary skill in the art that various alternatives may be constructed without departing from the scope or spirit of the present disclosure. Indeed, one of skill in the art will appreciate that if it is desired to have a slide assembly having only a lock-in position, then a latch system could include the first latch assembly 60 that is connected to the first slide member 10, while if it is desired to have only a lock-out position, then a latch system could include the second latch assembly 70 that is connected to the first slide member 10 and the third latch assembly 80 that is connected to the second slide member 20.

Thus, although an example method and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A slide assembly comprising:

a first slide member, a second slide member and a third slide member;

the slide members being slidably connected in a telescoping configuration;

a handle assembly connected to the first slide member;

a latch system configured to releasably lock the first slide member relative to the second slide member and to lock the second slide member relative to the third slide member;

the latch system configured to unlock the first slide member relative to the second slide member and to unlock the second slide member relative to the third slide member to allow movement of the slide members from a locked open, fully extended position toward a closed, fully retracted position when an actuation force is applied to the handle assembly in a direction toward the closed, fully retracted position, and to allow movement of the slide members from a locked closed, fully retracted position toward an open, fully extended position when an actuation force is applied to the handle assembly in a direction toward the open, fully extended position; and the latch system further comprises a first latch assembly, a second latch assembly and a third latch assembly, wherein the first latch assembly includes a first latch, the second latch assembly includes a second latch, and the third latch assembly includes a third latch, and wherein each of the first, second and third latches is pivotally connected to the slide assembly.

2. The slide assembly of claim 1, further comprising a releasable lock-in position when the slide members are moved to a closed, fully retracted position.

3. The slide assembly of claim 2, wherein the first latch assembly of the latch system is connected to the first slide member.

4. The slide assembly of claim 1, further comprising a releasable lock-out position when the slide members are moved to an open, fully extended position.

5. The slide assembly of claim 4, wherein at least one of the latch assemblies is connected to the first slide member and at least one of the latch assemblies is connected to the second slide member.

6. The slide assembly of claim 1, further comprising a releasable lock-in position when the slide members are moved to a closed, fully retracted position and a releasable lock-out position when the slide members are moved to an open, fully extended position.

7. The slide assembly of claim 1, wherein the first latch assembly is connected to the first slide member, the second latch assembly is connected to the first slide member, and the third latch assembly is connected to the second slide member.

8. The slide assembly of claim 1, wherein each of the first, second and third latch assemblies further comprises a resilient member.

9. The slide assembly of claim 8, wherein each of the first, second and third latches is resiliently biased to a neutral position.

10. The slide assembly of claim 1, wherein the third slide member further comprises a front stop proximate a front end of the third slide member and a rear stop proximate a central region of the third slide member, and the second slide member further comprises a stop proximate a front end of the second slide member.

11. The slide assembly of claim 10, wherein the first latch further comprises a locking member that engages the front stop on the third slide member when the slide assembly is in a closed, fully retracted position.

12. The slide assembly of claim 10, wherein the second latch further comprises a locking member that engages the stop on the second slide member when the slide assembly is in an open, fully extended position.

13. The slide assembly of claim 10, wherein the third latch further comprises a locking member that engages the rear stop on the third slide member when the slide assembly is in a closed, fully retracted position.

14. The slide assembly of claim 10, wherein the first latch is engageable with a front stop connected to the third slide member, the second latch is engageable with a stop connected to the second slide member, and the third latch is engageable with a rear stop connected to the third slide member.

15. The slide assembly of claim 1, wherein the handle assembly further comprises a handle and a slider, the slider being connected to and slidable relative to the first slide member.

16. The slide assembly of claim 15, wherein the slider is configured to engage and rotate the first latch when the handle is pulled in the direction of extending the slide assembly and to engage and rotate the second latch when the handle is pushed in the direction of retracting the slide assembly.

17. The slide assembly of claim 1, wherein the first slide member further comprises bearing retainer stops proximate a rear end of the first slide member, the second slide member further comprises bearing retainer stops proximate front and rear ends of the second slide member, and the third slide member further comprises bearing retainer stops proximate a front end of the third slide member.

18. The slide assembly of claim 1, wherein the slide assembly further comprises a resilient block connected to the second slide member that provides cushioned stopping for the first slide member relative to the second slide member and for the second slide member relative to the third slide member.

19. A slide assembly comprising:

a first slide member, a second slide member and a third slide member;

the slide members being slidably connected in a telescoping configuration;

a handle assembly connected to the first slide member and further comprises a handle and a slider, the slider being connected to and slidable relative to the first slide member;

a latch system configured to releasably lock the slide members with respect to each other and further comprising a first latch assembly including a first latch, a second latch assembly including a second latch, and a third latch assembly including a third latch;

the latch system configured to be unlocked and to allow movement of the slide members when an actuation force is applied to the handle assembly in a direction of intended movement of the slide members; and wherein the slider is configured to engage and rotate the first latch when the handle is pulled in the direction of extending the slide assembly and to engage and rotate the second latch when the handle is pushed in the direction of retracting the slide assembly.

20. A slide assembly comprising:

a first slide member, a second slide member and a third slide member;

the slide members being slidably connected in a telescoping configuration;

a handle assembly connected to the first slide member;

a latch system configured to releasably lock the slide members with respect to each other and further comprising a first latch assembly including a first latch, a second latch assembly including a second latch, and a third latch assembly including a third latch;

wherein the third slide member further comprises a front stop proximate a front end of the third slide member and a rear stop proximate a central region of the third slide member, and the second slide member further comprises a stop proximate a front end of the second slide member, and the first latch further comprises a locking member that engages the front stop on the third slide member when the slide assembly is in a closed, fully retracted position; and the latch system configured to be unlocked and to allow movement of the slide members when an actuation force is applied to the handle assembly in a direction of intended movement of the slide members.

* * * * *